United States Patent [19]

Timuska

[11] Patent Number: 4,758,138

[45] Date of Patent: Jul. 19, 1988

[54] OIL-FREE ROTARY GAS COMPRESSOR WITH INJECTION OF VAPORIZABLE LIQUID

[75] Inventor: Karlis Timuska, Spånga, Sweden

[73] Assignee: Svenska Rotor Maskiner AB, Stockholm, Sweden

[21] Appl. No.: 16,384

[22] PCT Filed: Jun. 6, 1986

[86] PCT No.: PCT/SE86/00272

§ 371 Date: Jan. 23, 1987

§ 102(e) Date: Jan. 23, 1987

[87] PCT Pub. No.: WO86/07416

PCT Pub. Date: Dec. 18, 1986

[30] Foreign Application Priority Data

Jun. 7, 1985 [SE] Sweden ..... 8502838

[51] Int. Cl.[4] ..... F04C 18/16; F04C 27/02; F04C 29/02; F04C 29/04

[52] U.S. Cl. ..... 418/100; 418/201; 418/DIG. 1

[58] Field of Search ..... 418/97, 100, 201, DIG. 1

[56] References Cited

U.S. PATENT DOCUMENTS 4,025,244 5/1977 Sato ..... 418/DIG. 1
4,035,114 7/1977 Sato ..... 418/97
4,062,199 12/1977 Kasahara ..... 418/97
4,551,989 11/1985 Lindahl ..... 418/97

*Primary Examiner*—John J. Vrablik
*Attorney, Agent, or Firm*—Frishauf, Holtz, Goodman & Woodward

[57] ABSTRACT

An oil-free rotary gas-compressor system includes an oil-free rotary gas-compressor (2) having a high, built-in pressure ratio and an injector arrangement (13) for injecting a vaporizable liquid, preferably water, into the compressor (2) for cooling the gas during the compression process. It is known in high-speed compressors to utilize water injection which is so restricted that the water is completely vaporized, to thereby obtain a good cooling effect. The efficiency of the compressor is limited, however. In known systems, high compressor efficiencies are obtained by injecting large quantites of water, although the compressor speed must then be considerably reduced, resulting in a lower compressor capacity. According to the present invention, a correspondingly high efficiency can be obtained, however, in a high-speed compressor when the water is injected into the compressor in a weight quantity which is greater than the maximum amount of liquid permitted for obtaining a complete vaporization of the liquid during the compression of the gas up to an amount that is four times greater than said maximum amount.

15 Claims, 1 Drawing Sheet

AN OIL-FREE ROTARY GAS COMPRESSOR WITH INJECTION OF VAPORIZABLE LIQUID

BACKGROUND OF THE INVENTION

The present invention relates to an arrangement in an oil-free rotary gas compressor which has a high, built-in pressure ratio and which is provided with means for injecting liquid thereinto, preferably water, for the purpose of cooling the gas under compression.

By high, built-in pressure ratio is meant here and in the following a ratio which is greater than about 4:1.

Oil-free gas compressors are commonly used to compress air from atmospheric pressure to pressures in the region of from 8 to 12 bars. In known compressors of this kind, considerable quantities of water are injected, in order to restrict the terminal temperature of a compression stage to about 50° C., at an incoming air temperature of about 20° C. The rise in temperature corresponds to a mass ratio, water/air, of 10:1 or thereabove, although it is known to limit this ratio to 1.4:1. The amount of water injected into the compressor per unit of time would, if it were to be consumed, constitute a substantial part of the operating costs. Consequently, the water is removed and re-cycled subsequent to being cooled, and optionally also reconditioned. The water-removal system, which also incorporates a quantity of buffer water and the conditioning system, which protects against, inter alia, the formation of bacteria, lime deposits and acidification, is highly space consuming and should be constructed from a corrosion resistant material. The system, when connected to a water injection compressor, is therefore expensive. Water injection also necessitates a marked reduction in compressor speed, with a subsequent reduction in capacity.

In the case of a corresponding dry single-stage compressor, outlet temperatures in the order of 350°–400° C. are reached, resulting in large temperature gradients in the various compressor components, and therewith excessive play therebetween and poor efficiency. In order to overcome this, it is necessary to compress the gas in two or more stages and to cool the gas between consecutive stages. This solution, however, results in a compressor of large dimensions, particularly when the cooling arrangements are included in the dimensions of the apparatus as a whole.

The advantages and disadvantages encountered with liquid injection compressors and dry compressors have been detailed in "Mechanical Engineers' Handbook" (1951), McGraw-Hill Book Company, Inc. On page 1879 of this publication there is also proposed a solution which is intended as a compromise between the small dimensions and high speeds of the dry compressor on the one hand and the beneficial cooling effect of the liquid injection compressor on the other. This compromise solution comprises injecting a restricted quantity of water into the inlet of a high speed single-stage compressor, so that all the water is vaporized by the heat generated during the compression process. It has been found that this will enable the outlet temperature to be restricted to 100°–150° C., while reducing temperature gradients and play and improving efficiency to a corresponding degree in comparison with a dry single-stage compressor. The efficiency is lower, however, than that of the initially mentioned water injection low speed compressor.

Thus, according to the aforesaid handbook, an ineffective area is found with regard to the quantity of water injected per unit of time, namely between the limited liquid injection and the injection of considerable quantities per unit of time. This conclusion has prevailed for approximately 25 years.

The object of the present invention is to provide an improvement in oil-free rotary-gas compressors with liquid injection in relation to the total capacity requirement of the compressor.

Contrary to the practice documented in the aforesaid handbook, this object has been achieved in accordance with the present invention by constructing the liquid injection arrangement in a manner which will enable the liquid to be injected in a weight quantity relative to the weight quantity of the gas supplied which is greater, although not more than four times greater, than that required to achieve complete vaporization of the liquid during the compression process. The result of this improvement is that in the final stage of the compression process, water which has not vaporized will lie on the surfaces of the compression chamber, these surfaces being colder than the surroundings, and there seal leakage through the play between the actual rotors themselves and between the compressor housing and the rotors, while keeping the amount of water in the compressor outlet is so small as to produce but small dynamic losses, this water being removed with the aid of a simple condensation separator and either discharged to sewage or recycled through a simple recycling system. If such a system is required, it need only be of simple and inexpensive construction, due to the small amount of water concerned and also due to the fact that there is less need to clean the system than in the case of conventional water injection systems service requirements are, naturally, considerably less.

Further characteristics of arrangements according to the invention are set forth in the claims.

DETAILED DESCRIPTION

Figure 1:
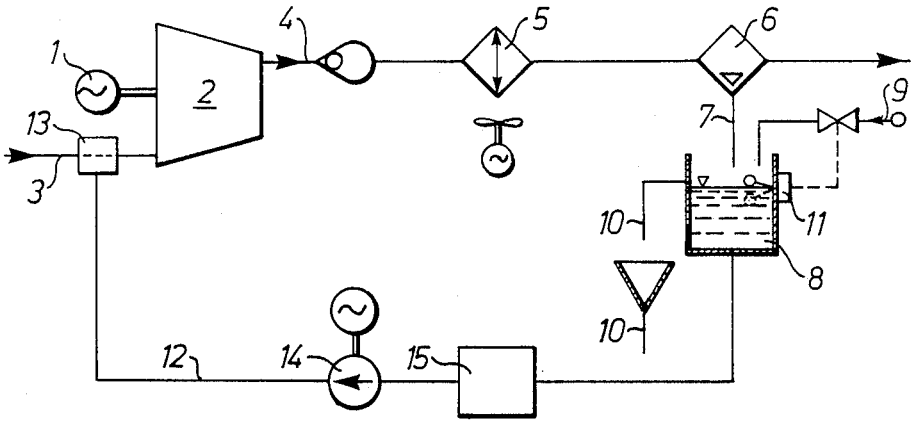
FIG. 1 illustrates schematically an embodiment of an arrangement according to the invention.

The arrangement illustrated schematically in FIG. 1 comprises a screw compressor 2 which is driven by an electric motor 1 and which has connected thereto an inlet pipe 3 and an outlet pipe 4. The outlet pipe 4 incorporates a cooling arrangement 5 and a condensation separator 6. A conduit 7 conducts condensation which has collected in the separator 6 to a buffer container 8, which is provided with an arrangement 11 for maintaining a constant level of water in the container 8, said arrangement 11 being connected to a water delivery pipe 9 and a discharge pipe 10. A pipe 12 extends from the bottom of the container 8 to an injection device 13 located in the inlet pipe 3 of the compressor 2. The pipe 12 has a metering pump 14 incorporated therein. When required, a simple arrangement 15 for conditioning the water flowing through the pipe 12 may be connected to said pipe, primarily for neutralizing any acid which forms in the circulating water.

Surplus, non-vaporized water does not contribute to the cooling of the gas to any appreciable extent. Neither does it decrease the amount of water vaporized in any decisive manner. The cooling effect is therefore substantially unchanged and is determined by the amount of water that has vaporized. The surplus water has the function of seating on the rotor surfaces, which are colder than the surroundings, and seals the gaps caused by play between the actual rotors themselves and between said rotors and the rotor housing, to thereby increase efficiency with increasing water supply within the given mass ratio.

Regulation of the pump 14 is thus not a critical cooling parameter. When the pressure ratio of the compressor and the temperatures and moisture content of the incoming gas are known values, the pump can be controlled in dependence on the mass flow in the inlet pipe 3. Alternatively, the temperature of the gas in the compressor outlet pipe 4 can be detected for the same purpose, or the amount of condensation per unit of time obtained from the condensation separator 6. This latter control principle provides extremely accurate results, irrespective of variations in the moisture content of the incoming gas.

Under normal operating conditions, the pressure in the compressor inlet pipe 3 is about 100 kPa, while the pressure in the compressor outlet pipe is about 800 kPa. Finely divided water is injected from the pipe 12 into the inlet pipe 3 in a quantity per unit of time dependent on the magnitude of the incoming flow.

Part of the water injected into the compressor is vaporized during compression of the gas in the compressor 2 and the subsequent increase in temperature, until the gas has become saturated with water vapor. The water which remains, this water reaching at a maximum to about four times the amount of water vaporized, including that which accompanies the incoming gas, passes through the compressor in a liquid state and seals the gaps formed by the play between the actual rotors themselves and between the rotors and the rotor housing.

The water vapor condenses in the outlet pipe during its passage through the cooler 5, and the condensation is collected in the separator 6, from where it runs down into the buffer container 8. Initially, the container 8 is filled with water from the pipe 9 by means of the arrangement 11 until a desired water level is reached, which is then held constant in a known manner, by supplying water from the pipe 9 and tapping off water through the outlet 10.

Figure 2:
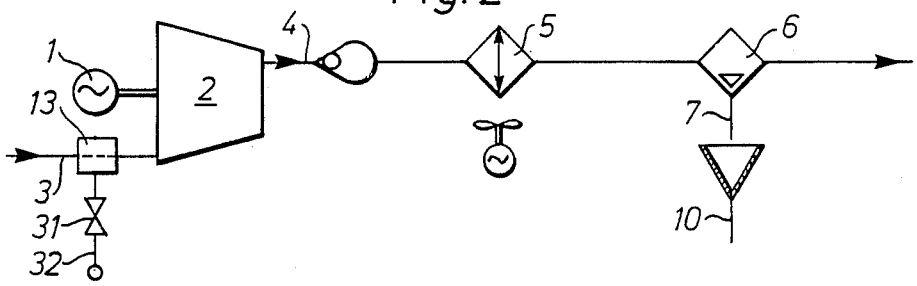
FIG. 2 illustrates a simplified construction of the same arrangement.

When the amount of water injected into the compressor is restricted to a value lying in the vicinity of the lower limit value, the amount of water consumed is so small that the costs entailed in recovering and recycling the water of condensation from the condensation separator 6 becomes greater than the costs entailed in drawing a corresponding amount of water from the water mains. FIG. 2 illustrates a modified version of the arrangement illustrated in FIG. 1. In the modified version of the arrangement the water is injected into the compressor 2 via valve 31 from the water mains pipe 32, and the water of condensation is conducted from the separator 6 to the discharge pipe 10.

Figure 3:
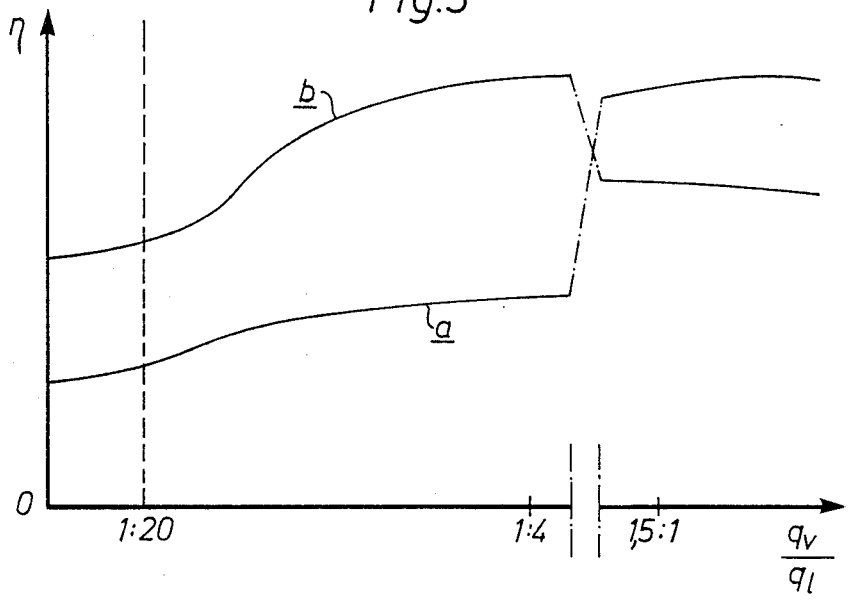
FIG. 3 is a curve illustrating the efficiency achieved as a function of the mass ratio between the quantity of liquid injected and the quantity of gas supplied.

FIG. 3 illustrates efficiency curves relating respectively to a conventional, liquid flooded compressor driven at low peripheral speed, curve a, and to a dry compressor driven at high peripheral speeds, curve b. Both curves show the efficiency $\eta$ as a function of the mass ratio between the amount of liquid injected and the amount of gas supplied.

In the case of a compressor according to curve a, the level of efficiency is greatly dependent on the temperature of the water injected into the compressor. (This may be due to a high increase in the partial volume of the water when injected into the compressor).

It will be seen from curve a that a high efficiency is obtained when injecting a large quantity of liquid per unit of time, namely about 1.5:1 and thereabove. In the case of a compressor according to curve b the level of efficiency is in depedent of the temperature of the water injected, within certain limits.

When water is injected into a dry compressor, the efficiency of the compressor will be low both in respect of a mass ratio which is so low that the liquid is vaporized with improved cooling as a result, as previously mentioned, and in respect of liquid flooding in a conventional manner, which latter is only to be expected since the peripheral speed of the rotors has been adapted for dry operation. What has not previously been observed is that the intermediate part of the curve b, during which no improved cooling is obtained, presents a peak value which is comparable with the efficiency of the conventional liquid-flooded compressor. It should also be noted that the compressor represented by the efficiency curve b has a far greater capacity due to the fact that it operates at a peripheral speed which is from 2 to 5 times greater.

A typical example of a maximum mass ratio of liquid to gas for obtaining a complete vaporation of the liquid (water) is 1:20 in the case of compression to a pressure ratio of 8:1 of dry air at room temperature and adiabatic compression work, which mass ratio is shown in FIG. 3.

The quantity of water injected, which results in increased efficiency, can then be brought to the mass ratio of 1:4, between which values the arrangement according to the invention operates. Although a relatively high efficiency is obtained at greater mass ratios, the increase is obtained at the cost of the expense of apparatus for recycling and reconditioning the circulating liquid, which renders a greater mass ratio less attractive.

In order to reduce the axial propagation of heat along the surfaces of metal rotors, the rotors are preferably covered with a heat insulating layer, for example by oxidizing the surfaces or by coating the surfaces of the rotors with a layer of polymeric material. The surface layer is also preferably made as hydrophilic as possible, in order that the water lies on the surfaces of the rotors to the greatest extent possible, so as to improve the sealing function of the water. The water need not be injected into the compressor in the vicinity of its inlet, but may alternatively, or in addition, be injected through holes formed in the compressor housing in a manner known per se.

In accordance with a feature of the present invention, the compressor (2) may be a single-stage screw compressor which has substantially the same peripheral speed and dimensions as a first stage in a corresponding two-stage dry compressor.

I claim:

1. In an oil-free rotary gas-compressor system including an oil-free rotary gas-compressor (2) having a high, built-in pressure ratio and means (13) for injecting a vaporizable liquid into said compressor (2) for the purpose of cooling the gas under compression, the improvement wherein:

said liquid injecting means (13) includes means for injecting the vaporizable liquid in a weight quantity in the gas in relation to the weight quantity of gas supplied which is greater than the maximum amount of liquid permitted for obtaining a complete vaporization of the liquid during the compression of the gas up to an amount that is four times greater than said maximum amount.

2. The system of claim 1, further comprising:

a pressure line extending from an outlet side of said compressor (2); and a condensation separation (6) coupled to said pressure line; and wherein the amount of liquid injected is restricted to a value which permits the removal of all liquid including condensation from the compressed gas by means of said condensation separator (6).

3. The system of claim 2, including:

a buffer container (8) communicating with said condensation separator (6), said buffer container (8) having means (11) for maintaining a constant level of liquid in the buffer container;

a liquid supply line for supplying liquid to said compressor; and a regulator (14) coupling said liquid supply line to the inlet side of said compressor (2) for regulating the amount of liquid charged to said compressor (2) per unit of time.

4. The system of claim 3, wherein said weight quantity of liquid injected into said compressor (2), by said liquid injecting means (13), in relation to the weight quantity of gas supplied to said compressor (2), corresponds to a liquid-to-gas weight ratio of from 1:20 to 1:4.

5. The system of claim 2, wherein said weight quantity of liquid injected into said compressor (2), by said liquid injecting means (13), in relation to the weight quantity of gas supplied to said compressor (2), corresponds to a liquid-to-gas weight ratio of from 1:20 to 1:4.

6. The system of claim 1, wherein said weight quantity of liquid injected into said compressor (2), by said liquid injecting means (13), in relation to the weight quantity of gas supplied to said compressor (2), corresponds to a liquid-to-gas weight ratio of from 1:20 to 1:4.

7. The system of claim 6, wherein said compressor (2) is a single-stage screw rotor compressor and has substantially the same peripheral speed and dimensions as a first stage in a corresponding two-stage dry compressor.

8. The system of claim 5, wherein said compressor (2) is a single-stage screw rotor compressor and has substantially the same peripheral speed and dimensions as a first stage in a corresponding two-stage dry compressor.

9. The system of claim 4, wherein said compressor (2) is a single-stage screw rotor compressor and has substantially the same peripheral speed and dimensions as a first stage in a corresponding two-stage dry compressor.

10. The system of claim 3, wherein said compressor (2) is a single-stage screw rotor compressor and has substantially the same peripheral speed and dimensions as a first stage in a corresponding two-stage dry compressor.

11. The system of claim 2, wherein said compressor (2) is a single-stage screw rotor compressor and has substantially the same peripheral speed and dimensions as a first stage in a corresponding two-stage dry compressor.

12. The system of claim 1, wherein said compressor (2) is a single-stage screw rotor compressor and has substantially the same peripheral speed and dimensions as a first stage in a corresponding two-stage dry compressor.

13. The system of claim 1, wherein said injected vaporizable liquid is water.

14. The system of claim 2, wherein said injected vaporizable liquid is water.

15. The system of claim 3, wherein said injected vaporizable liquid is water.

* * * * *

UNITED STATES PATENT AND TRADEMARK OFFICE

CERTIFICATE OF CORRECTION

PATENT NO. : 4,758,138

DATED : July 19, 1988

INVENTOR(S) : K. TIMUSKA

It is certified that error appears in the above-identified patent and that said Letters Patent is hereby corrected as shown below:

Column 2, line 34, "systems service" should be

-- systems. Service --.

Column 4, line 10, "in dependent" should be -- independent --.

Signed and Sealed this

Seventeenth Day of January, 1989

*Attest:*

DONALD J. QUIGG

*Attesting Officer*

*Commissioner of Patents and Trademarks*